US005291620A

United States Patent [19]

Gilley

[11] Patent Number: 5,291,620

[45] Date of Patent: Mar. 8, 1994

[54] PUSH BUTTON TOILET FLUSH MECHANISM

[76] Inventor: Lonnie W. Gilley, 110 Clearview Dr., McMinnville, Tenn. 37110

[21] Appl. No.: 88,983

[22] Filed: Jul. 8, 1993

[51] Int. Cl.[5] ..... E03D 5/09

[52] U.S. Cl. ..... 4/410; 4/414; 4/404; 4/379; 4/393; 137/397; 137/448

[58] Field of Search ..... 4/386, 379, 380, 381, 4/382, 383, 384, 385, 392, 393, 394, 395, 402, 403, 404, 405, 410, 413, 414; 137/397, 410, 435, 448

[56] References Cited

U.S. PATENT DOCUMENTS

| | | | |
|---|---|---|---|
| 564,156 | 7/1896 | McShane | 137/397 |
| 4,365,365 | 12/1982 | Antunez | 4/393 |
| 5,141,644 | 8/1992 | Forde | 137/448 |
| 2,526,294 | 10/1950 | Stegeman . | |
| 3,823,425 | 7/1974 | Coffman . | |
| 3,860,979 | 1/1975 | Young . | |
| 4,134,165 | 1/1979 | Phripp et al. . | |
| 4,825,478 | 5/1989 | Harris . | |
| 5,179,739 | 1/1993 | Mann . | |

FOREIGN PATENT DOCUMENTS

| | | | |
|---|---|---|---|
| 0499913 | 11/1954 | Italy | 4/395 |

*Primary Examiner*—Henry J. Recla
*Assistant Examiner*—Gregory Vidovich
*Attorney, Agent, or Firm*—Pitts & Brittian

[57] ABSTRACT

A device for regulating the discharge of water from a storage tank associated with a toilet bowl for flushing of the toilet bowl, with the operation of the device being through slight pressure on a push button on a rod extending through a front or end wall of the storage tank. This device has a flapper assembly for opening and closing access to a drain from the storage tank, with this flapper assembly having a storage volume with an adjustable opening for controlled release of water therefrom to control the timing of the closure of the flapper assembly against the drain. A trigger assembly portion has a trigger arm with one end engaged with the push button and the other end adapted to engage a distal arm of a pivotal lever arm, this lever arm carrying a buoyant float. Release of the engagement of the distal ends of the trigger arm and the lever arm causes the lever arm to rise, due to the float, and the lever arm engages the flapper assembly to open the drain. All components, except the push button, are mounted from a common base member to facilitate installation within the storage tank.

16 Claims, 3 Drawing Sheets

PUSH BUTTON TOILET FLUSH MECHANISM

DESCRIPTION

Technical Field

The present invention relates generally to mechanisms for the discharge of water from the storage tanks of toilets, and more particularly to a mechanism operated by a push button, the mechanism including an adjustable delay volume to control the rate of operation.

Background Art

As is well known, a majority of toilets incorporate a holding or storage tank, commonly referred to as a flush tank, for containing a selected quantity of water for flushing purposes. When desired, the flushing mechanism is operated to release this water through a drain into the toilet bowl. When the water is substantially all discharged, the mechanism is caused to be reset and the water again fills the tank.

Operation of the flushing mechanism is usually effected by pivoting a handle mounted on the exterior of the tank, either on the front or the side thereof. However, very young persons and those with handicaps find this pivoting to be quite difficult. Even people without handicaps find the handle difficult to reach and operate while remaining on the toilet seat.

Various forms of flush tank mechanisms have been developed over the years, most utilizing a pivoting handle for operation. Typical of the prior units are illustrated in U.S. Pat. Nos. 2,526,294 issued to R. Stegeman on Oct. 17, 1950; 3,823,425 issued to R. Coffman on Jul. 16, 1974; 3,860,979 issued to S. Young on Jan. 21, 1975; 4,134,165 issued to C. Phripp on Jan. 16, 1979; 4,824,478 issued to J. Harris on May 2, 1989; and 5,179,739. The device of the '979 patent utilizes a pair of vertical rods (that are pulled), either of which can be used to initiate flushing. The device of the '739 patent also seems to depend upon a pull rod, although that is not clear from the description. A pull rod has similar deficiencies to handle-operated flushing units in that operation is difficult for small children, handicapped persons, etc. The devices of the '165, the '739 and the '979 patents utilize a delay volume to regulate operation speed, the delay volumes of each having a fixed aperture for the draining of the water; thus, there is no adjustment of this regulation.

Accordingly, it is an object of the present invention to provide a toilet flush mechanism that can be operated by a simple push, with a force of only a few ounces, such that it is easily manipulated by small children and handicapped persons.

It is another object of the present invention to provide a flushing mechanism wherein the rate of water draining from a delay volume can be adjusted so as to adjust the timing of the operation.

It is a further object of the present invention to provide a flushing mechanism that can be fabricated from non-corrosive materials using simple manufacturing techniques such that costs thereof are minimized.

Another object of the present invention is to provide a complete replacement flush mechanism, with portions being replaceable, for toilet units such that conventional flush tanks can be utilized.

These and other objects of the present invention will be fully understood by reference to the drawings that accompany a complete description of the invention.

DISCLOSURE OF THE INVENTION

In accordance with the present invention, there is provided a mechanism for installation within a flush tank for a toilet. This mechanism includes a trigger arm, which normally retains a flush rod lever in an engaged position, that is pivotally moved upon the application of a light pressure to a push button. A float attached to the flush rod lever causes the lever to rise when disengaged from the trigger arm, thereby raising a valve plug from a valve seat such that water is dispensed from the tank into the toilet bowl. As the water is dispensed, the float gradually moves the flush rod lever downward until it is again disposed so as to be retained by the trigger arm. During this resetting of the flush rod lever, the valve plug is temporarily delayed from closing against the valve seat by a "storage volume" attached to the valve plug, this storage volume having an outlet port that is adjustable in effective size such that the flow of water from the storage volume is controlled. When sufficient water has been drained to allow the trigger mechanism to reset, the valve plug drops against the valve seat such that water can begin to refill the tank. The rate of operation can thus be adjusted to minimize usage of water after resetting. In a preferred embodiment, all of the elements of the present invention, including a conventional overflow, are mounted from a common base such that an entire assembly can be installed in a toilet storage tank.

BEST MODE FOR CARRYING OUT THE INVENTION

Figure 1:
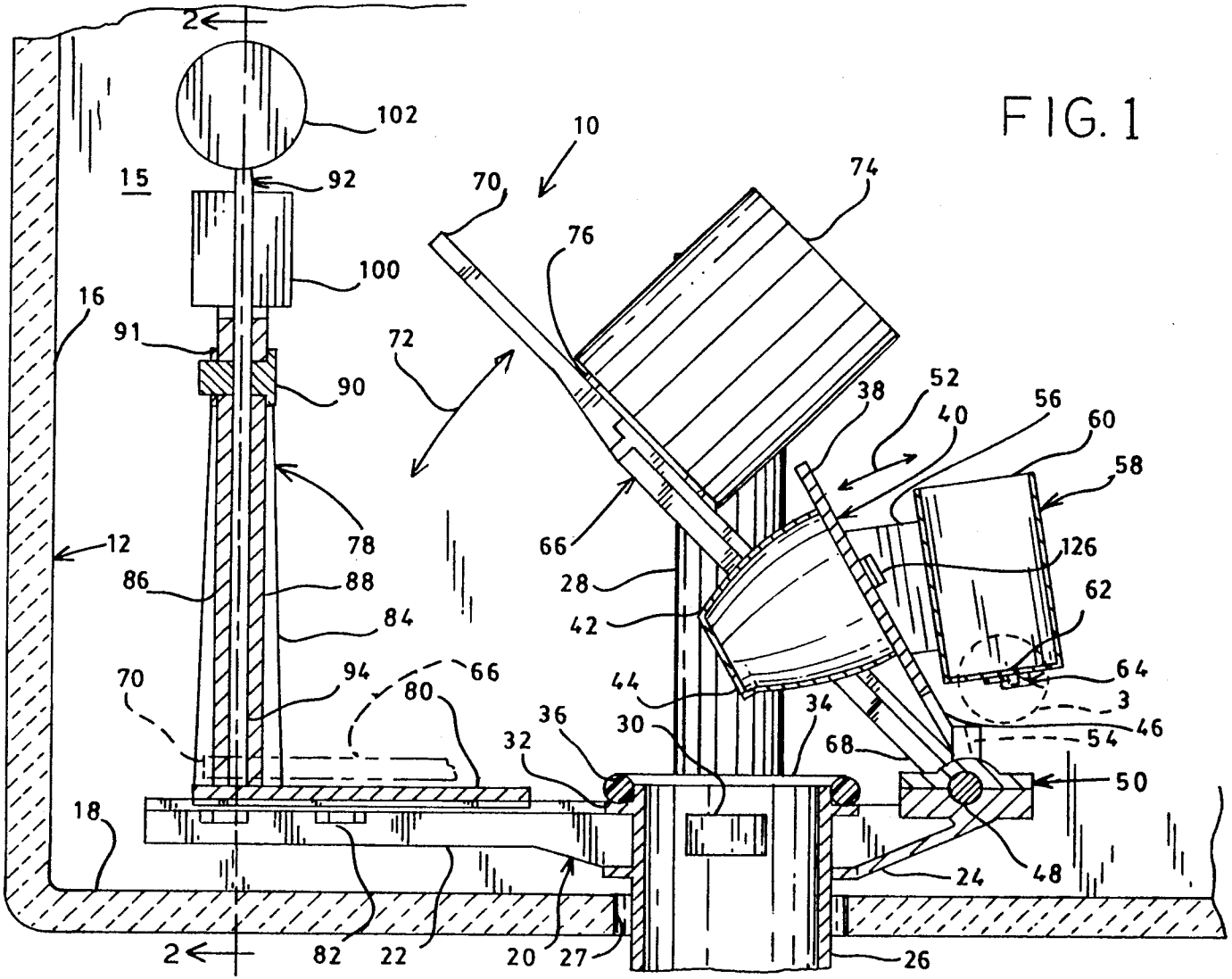
FIG. 1 is a vertical elevational view, partly in cross-section and partly cut away, of a flush mechanism for a toilet flush tank according to the present invention, the view being taken in a vertical plane parallel to a long dimension of the flush tank.

An understanding of the present invention, shown generally at 10, can be made by referring to FIG. 1, in particular. The device 10 is intended to be installed in a flush tank 12 of conventional form having oppositely disposed front and back walls 14, 15 (only back wall 15 shown), and oppositely disposed end walls 16, 17 (only one end wall 16 shown). The tank has a bottom wall 18 that normally rests upon a lower unit of the toilet (not shown); however, the tank can be mounted above the lower unit in some installations.

The device 10 is designed to substantially replace all flushing components within a conventional tank 12 with the exception of any conventional water inflow mechanism (not shown). In this connection, there is a base 20 that serves as a trigger support portion 22 and a lever arm and flapper support portion 24. Typically, this base 20 also includes an integral drain tube 26 for passing through a hole 27 in the tank bottom 18 and an overflow standpipe 28. The overflow standpipe 28 is connected to the drain tube 26 through an opening 30. Of course, these components can all be integral or can be separate portions joined by appropriate means. For durability and freedom from corrosion, these components are fabricated from a suitable plastic, such as molded PVC or the like.

The drain tube 26 terminates at the top in an annular shoulder 32 with an upstanding rim 34. Surrounding, and extending a small distance above, this rim 34 is an elastomeric gasket 36, typically in the form of an "O-ring" that is supported by the shoulder 34 and held in place by friction against the wall of the drain tube 26. This gasket 36 provides a seal for a flat surface of a plate 38 of a flapper assembly 40. This flapper assembly 40 has a typically-shaped bulb 42 with a bottom vent 44 that drops within the drain tube 26 when the surface 38 is against the gasket 36 in the same manner as conventional flapper-type valves.

An extension 46 of the plate 38 is pivoted at pin 48 of a retainer assembly 50. This permits movement of the flapper assembly 40 in the direction indicated by the double-ended arrow 52. The flapper assembly 40 is shown in a mid-position relative to its movement: in its lowest position, the plate 38 is against the gasket 36; and in its most upper position, it bears against a stop 54 which is formed as an integral portion of the retainer 50 assembly (in the preferred form). This stop 54 prevents elevation of the flapper assembly 40 above a position where gravity will cause the flapper plate 38 to seal against the gasket 36 when water has adequately drained from the tank 12.

Mounted to the back of the flapper plate 38, as with a web 56, is a delay volume 58 for the purposes described hereinafter. When this delay volume 58 is full of water, as immediately after initiating a flush, the weight of the water biases the flapper assembly 40 in the fully raised position. This delay volume has an open upper end 60, and the lower wall is provided with a port 62. Further, this port 62 has an adjustable closure 64 that is described in detail in connection with FIG. 3. When sufficient water has passed through the port 62, the weight of the flapper assembly 40 causes it to close against the gasket 38 such that the tank 12 can again be filled with Water.

An operating lever arm 66 has a first end 68 pivotally supported by pin 48 and a distal end 70. This pivotal mounting permits the lever arm 66 to move in directions indicated by the double-headed arrow 72. Mounted on a back surface of this lever arm 66 is a buoyant float 74 generally intermediate the ends 68, 70. Attachment on the lever arm 66 can be accomplished, for example, by a key member 76 within a key way (not shown). Typically, a set screw (not shown) can be utilized to lock the float 74 in position along the lever arm 66. Other attachment means Will be known to persons skilled in the art. This float 74 provides a lifting force upon the lever arm 66 when the tank 12 contains water.

Figure 2:
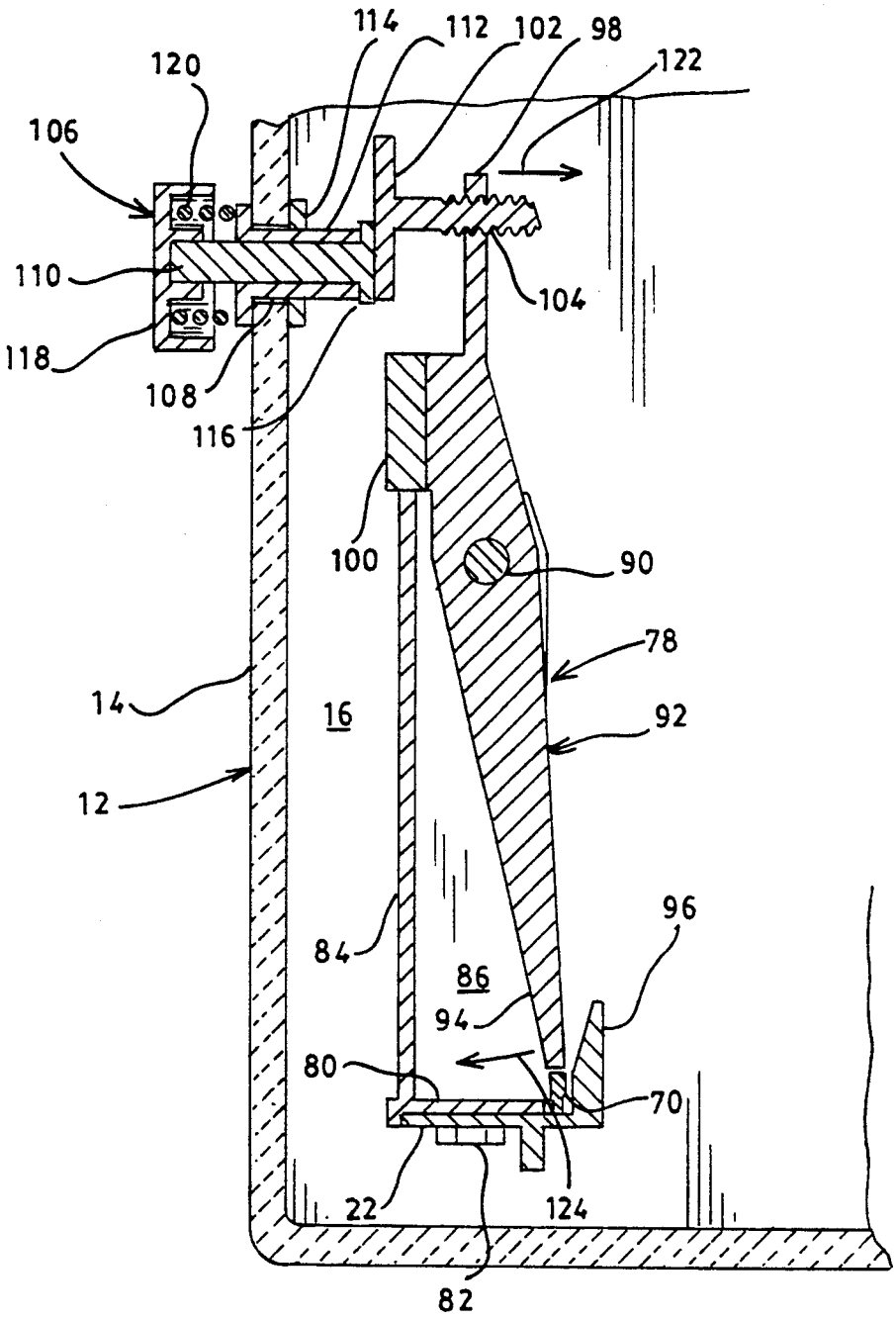
FIG. 2 is a vertical cross-sectional view of the flush mechanism of FIG. 1, taken at 2—2 thereof, that is generally orthogonal to the view of FIG. 1.

The push button and trigger assembly 78 of the present invention is shown at the left in FIG. 1, and in FIG. 2 which is a cross-section taken at 2—2 in FIG. 1 toward the end 16 of the tank 12. This trigger assembly 78 has a base portion 80 that can be attached to the trigger support 22 as with fasteners 82. This base portion 80 is typically provided with a slot (not shown) to permit adjustment of assembly 78 as to spacing from the drain tube 26. The fasteners 82 then hold the base portion 80 in a selected position. If desired a vertical extension (not shown) can be attached to the base portion so to elevate the assembly 78 relative to the position illustrated. Upstanding from this base portion 80 is a back plate 84 and a pair of side plates 86, 88. Interposed between these side plates 86, 88, and pivotally mounted on a pin 90 (which is, for example, held With a retainer ring 91) is a trigger arm 92. The distal end 94 of the trigger arm 92 is utilized to engage the distal end 70 of the lever arm 66 when in the position indicated by the phantom lines. As indicated specifically in FIG. 2, there is a guide 96 for this distal end 70 of the lever arm 66 such that it will be in a position to be engaged by the distal end 94 of the trigger arm 92. Attached (by any suitable means) intermediate an opposite end 98 of the trigger arm 92 and the pivot pin 90 is a trigger counterweight 100 which normally maintains the trigger arm 92 in an upright position. A trigger adjustment disk 102 is attached to a threaded shaft 104 (see FIG. 2) that is threadably engaged with the trigger arm 92 proximate this other end 98, the purpose of this adjustment disk 102 will be understood from the discussion related to FIG. 2.

FIG. 2 more clearly shows the components of the trigger assembly 92 together with a push button assembly 106 that work together to initiate flushing of the tank 12. In the position illustrated, the trigger arm distal end 94 is shown as "capturing" the distal end 70 of the lever arm 66. Guidance into this captured position is assisted by the guide 96.

The push button assembly 106 is assembled in an opening 108 in the front wall 14 of the tank 12. This assembly 106 has a push rod 110 that passes through a shouldered sleeve 112. The push rod has a distal end 116 with an expanded diameter that serves as a retainer. This rod is slidable within the sleeve 112, the sleeve 112 being retained within the opening 108 by suitable means, such as a threaded nut 114. The distal end 116 engages the aforementioned adjustment disk 102. External the tank wall 14 is the button 118 which is attached to the outer end of the push rod 110 by friction or any suitable means. Preferably a coil spring 120 or other biasing means is inserted between this button 118 and the shouldered sleeve 112 to maintain the button 118 in the outermost position.

In FIG. 2 it can be seen that when the button 118 is pressed, as with a very small force, the push rod 110 with its expanded distal end 116 is moved inward within the tank 12. Movement of the distal end 116, which is against the disk 102, causes the end 98 of the trigger arm 92 to move in the direction indicated by arrow 122. Since the trigger arm 92 is pivoted at pin 90, the distal end 94 of the trigger arm 92 moves in a direction indicated by arrow 124. By this movement, the distal end 70 of the lever arm 66 is released and, due to the buoyancy of the float 74, the lever arm 66 is raised to above the general position shown in solid lines in FIG. 1. As the lever arm 66 rises, it engages an extension 126 (see FIG. 1) On the flapper plate 38 causing the flapper assembly 40 to be operated thereby opening up the drain 26 for flushing operation. Upon release of the button 118, the spring 120 causes the button 118 to return to its initial position. At the same time, the counterweight 100 causes the trigger arm 92 to return to a fully upright position ready to recapture the distal end 70 of the lever arm 66 during the next flushing operation.

Figure 3:
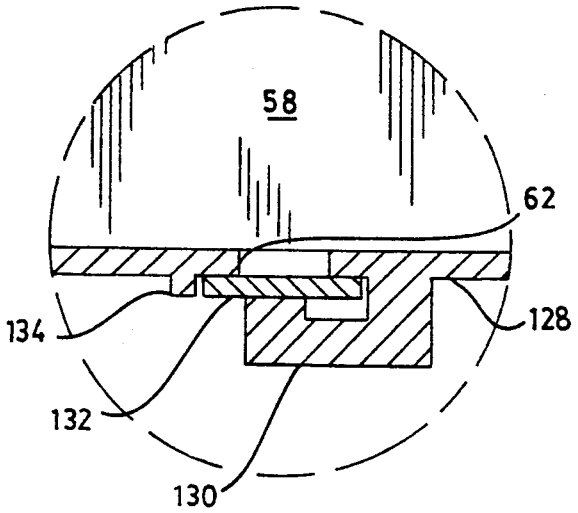
FIG. 3 is an enlarged cross-sectional view of the adjustable port of the storage or delay volume.

As discussed above, a delay volume 58 mounted to the flapper assembly 40 regulates the timing of the seating of the flapper plate 38 against the gasket 36. Referring now to FIG. 3, which is an enlarged drawing of a portion of FIG. 1 taken at 3 thereof, the manner of controlling this timing will be best understood. The bottom wall 128 of the delay volume 58 contains the afore-mentioned opening 62. In a preferred embodiment, this opening 62 is an elongated opening. The bottom wall 128 has a slideway 130 formed thereon (or attached) in which a slide 132 can be moved axially to expose more or less of the opening 62. A guide 134 is adjacent the slideway 130 to contain the slide 132 during its movement. Thus, if the opening 62 is effectively enlarged, water will drain more rapidly and the cycling time of the flapper assembly 40 will be more rapid. The opposite is true when the opening 62 is effectively made smaller by the slide 132. This construction provides essentially an infinite number of selections of times from a minimum to maximum to allow sufficient time for the trigger to reset, but little more to conserve water.

One of the objects of the present invention is to provide a flushing apparatus that is operated by a push button that can be mounted either in the front wall or the end wall of a tank. The embodiment illustrated in FIGS. 1 and 2 are for a unit having the push button installed in the front wall. However, only slight modification is required to utilize an end wall mounted push button. For example, the trigger assembly 78 can be rotated, as by repositioning the base plate 80 on the trigger support 22. In this position, the trigger arm 92 will move in the same plane as does the lever arm 66, with the trigger arm distal end 94 again engaging the distal end 70 of the lever arm 66.

Figure 4:
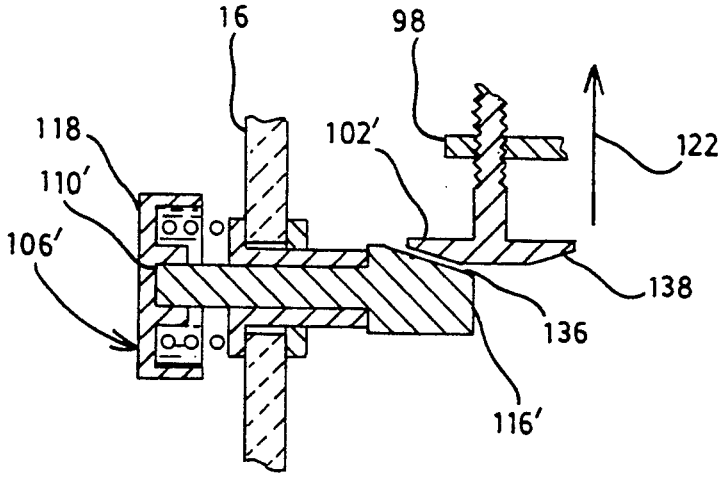
FIG. 4 is a top view, in section, of a variation of a push button assembly for initiating flushing of a toilet according to the present invention.

Another alteration that can be made for end-mount of the push button is illustrated in FIG. 4, which is a top view of the embodiment. For this embodiment, the push rod distal end 116' and the adjustable disk 102' are slightly altered, as shown, to provide substantially complimentary sloped surfaces 136, 138. Then, as the button 118 is pushed, the distal end 116' will move the disk 102' causing the trigger arm upper end 98 to again be moved in the direction 112 such that the trigger arm end 94 is disengaged from the lever arm end 70 causing the flushing operation to begin.

Of course, other slight alterations will be recognized by persons skilled in the art to convert the major components of the present invention into an end-mounted push button assembly.

A complete cycle of operation of the present invention is as follows (referring to FIGS. 1 and 2), assuming that a toilet tank is full, ready to flush. In this initial condition, the distal end 70 of the lever arm 66 is engaged by the distal end 94 of the trigger arm 92. Also, the flapper assembly plate 38 is against the gasket 36 to prevent leakage of water from the tank 12 into the drain 26. When flushing is desired, a slight pressure against the button 118 applies pressure against the disk 102 thereby causing pivotal movement of the trigger arm 92 around the pin 90. This pivotal movement (see arrows 122, 124) disengages the trigger arm distal end 94 from the lever arm distal end 70. In view of the buoyancy of the float 74, the lever arm 66 is raised to its upper most position. During this rising action, the lever arm 66 engages an extension 126 on the flapper assembly plate 38, causing the flapper assembly 40 to be raised from the gasket 36 and thus permitting flow of water through the drain 26. As the water level in the tank 12 decreases, the float 74 is lowered such that, at substantially complete water removal, the lever arm distal end 70 again becomes engaged and held by the trigger arm distal end 94 so as to be ready for the next flushing cycle. At this time sufficient water will have drained from the flush tank 12 to effect flushing of the toilet. In the interim, water in the delay volume 58 will drain out at a rate adjusted so the flapper plate 38 will fall against the gasket 36 immediately after the trigger arm 92 has reset. In this position, water can again be added to the tank 12 through any suitable fill line. Should excessive water attempt to be added to the tank 12, this excess water will flow down through the standpipe 28 and into the drain 26 through the opening 30.

The various components of the present invention are generally shown to corresponding scale in the figures. However, the sizes illustrated and the exact positions thereof are not for the purpose of limiting the present invention. Rather, the invention is to be limited only by the appended claims and their equivalents.

I claim:

1. A push button toilet flush mechanism for installation within a water storage tank associated with a toilet bowl, said flush mechanism comprising:

a base member for being positioned proximate a bottom of the storage tank, said base member having a flapper assembly support portion and a trigger support portion;

a drain portion carried by said base member for carrying water from the storage tank into the toilet bowl, said drain portion having a top rim and an annular shoulder positioned proximate said top rim;

a gasket member surrounding said drain portion and supported on said shoulder, said gasket member extending to a level above said top rim;

a flapper assembly having a flat plate with a first surface to seal against said gasket member when water is not to be removed from the storage tank, said flapper assembly further having a bulb portion attached to said first surface of said flat plate to be received within an opening into said drain portion at said top rim, said flat plate having one end mounted on a pivot of a pivot assembly on said flapper assembly support portion of said base member whereby said flapper assembly can be selectively pivoted toward and away from said drain portion, said flat plate further having a side extension;

a lever arm having a first end and a distal end, said first end pivotally mounted on said pivot assembly on said flapper assembly support portion of said base member whereby said lever arm can be selectively pivoted in a plane substantially parallel to a plane of motion of said flapper assembly, said lever arm having a portion for engagement with said extension of said flat plate of said flapper assembly when said lever arm rises from a lower position to an upper position;

a buoyant float member carried by said lever arm, said buoyant float member moving in response to water level in the storage tank;

a trigger assembly mounted on said trigger assembly support portion of said base member and extending substantially vertically within the tank, said trigger assembly having a trigger arm pivotally mounted on a pivot within said trigger assembly, said trigger arm having a first end disposed upwardly from said pivot and a distal end extending toward said base member, said distal end of said trigger arm engaging said distal end of said lever arm when water is substantially removed from the tank thereby preventing pivoting of said lever arm by said buoyant float member when water is placed within the tank; and a push button assembly mounted within a wall of the tank, said push button assembly having a push rod with a first end exterior the tank and a second end in contact with said first end of said trigger arm whereby movement of said push rod toward said first end of said trigger arm produces pivotal movement of said trigger arm and disengages said distal end of said trigger arm from said distal end of said lever arm whereby said buoyant float member moves said lever arm to said upper position and said flapper assembly to an open position by engaging said side extension of said plate of said flapper assembly.

2. The mechanism of claim 1 further comprising:

a water storage volume for receiving water from within the storage tank when water within the storage tank is at an upper level, said water storage volume having an opening in a bottom wall for release of water when the storage tank is substantially empty of water; and a web member joining said water storage volume to a opposite surface of said flat plate opposite from said bulb portion, said web member having a length whereby said water storage volume, when containing water, is a counterweight to said flat plate and bulb portion such that said flapper assembly remains in said open position for a selected time sufficient for said distal end of said trigger arm to re-engage with said distal end of said lever arm.

3. The mechanism of claim 2 wherein said storage volume is provided with a slide member for covering a selected portion of said opening in said bottom wall for selecting a time duration for said flapper assembly to remain in said open position until said distal end of said trigger arm has re-engaged said distal end of said lever arm.

4. The mechanism of claim 1 wherein said trigger assembly and said trigger assembly support portion of said base member are provided with means to selectively adjust a position of said trigger assembly on said trigger assembly support portion.

5. The mechanism of claim 1 wherein said pivot assembly on said flapper assembly support portion of said base member is provided with a stop to engage said flat plate of said flapper assembly to prevent excessive elevation of said flapper assembly by said lever arm.

6. The mechanism of claim 1 further comprising a standpipe carried by said base member and wherein said drain portion is provided with an overflow outlet communicating with said standpipe whereby water flowing into said standpipe is directed to said drain portion.

7. The mechanisms of claim 1 wherein said trigger assembly further comprises:

an disk member carried by said first end of said trigger arm, said disk member provided with adjustment for a distance from said first end of said trigger arm; and a counterweight attached to said trigger arm intermediate said first end of said trigger arm and said pivot for biasing said distal end of said trigger arm to a position for engaging said distal end of said lever arm.

8. The mechanism of claim 7 wherein said second end of said push rod of said push button assembly has an enlarged diameter portion in contact with said disk member, and said first end of said push rod carries a push button.

9. The mechanism of claim 8 further comprising a spring member between said push button and an exterior surface of the storage tank to bias said push button away from the storage tank wall.

10. The mechanism of claim 8 wherein said push button assembly is oriented orthogonally to a plane of motion of said trigger arm, and said disk member and said enlarged second end of said push rod have complimentary sloped surfaces of contact whereby axial motion of said push rod moves said disk member and thus said trigger arm to disengage said distal end of said trigger arm from said distal end of said lever arm.

11. A push button toilet flush mechanism for installation within a water storage tank associated with a toilet bowl, said flush mechanism comprising:

a base member for being positioned proximate a bottom of the storage tank oriented along a length of said storage tank, said base member having a flapper assembly support portion and an oppositely disposed trigger assembly support portion;

a drain portion carried by said base member for carrying water from the storage tank into the toilet bowl, said drain portion having a top rim and an annular shoulder positioned proximate said top rim, said rim defining an opening into said drain portion;

a gasket member surrounding said drain portion and supported on said shoulder, said gasket member extending to a level above said top rim;

a flapper assembly having a flat plate with a first surface to seal against said gasket member when water is not to be removed from the storage tank, said flapper assembly further having a bulb portion attached to said first surface of said flat plate to be received within said opening into said drain portion, said flat plate having one end mounted on a pivot of a pivot assembly on said flapper assembly support portion of said base member whereby said flapper assembly can be selectively pivoted toward and away from said drain portion, said flat plate further having a side extension;

a water storage volume for receiving water from within the storage tank when water within the storage tank is at an upper level, said water storage volume having an opening of adjustable size in a bottom wall for release of water when the storage tank is substantially empty of water;

a web member joining said water storage volume to a surface of said flat plate opposite from said bulb portion, said web member having a length whereby said water storage volume, when containing water, is a counterweight to said flat plate and bulb portion such that said flapper assembly remains in said open position for a selected time sufficient to re-engage said distal end of said trigger arm with said distal end of said lever arm;

a standpipe carried by said base member and wherein said drain portion is provided with an overflow outlet communicating with said standpipe whereby water flowing into said standpipe is directed to said drain portion;

a lever arm having a first end and a distal end, said first end pivotally mounted on said pivot assembly on said flapper assembly support portion of said base member whereby said lever arm can be selectively pivoted in a plane substantially parallel to a plane of motion of said flapper assembly, said lever arm having a portion for engagement with said extension of said flat plate of said flapper assembly when said lever arm rises from a lower position to an upper position;

a buoyant float member carried by said lever arm, said buoyant float member moving in response to water level in the storage tank;

a trigger assembly mounted on said trigger assembly support portion of said base member and extending substantially vertically within the tank, said trigger assembly having a trigger arm pivotally mounted on a trigger pivot within said trigger assembly, said trigger arm having a first end provided with a disk member disposed upwardly from said trigger pivot and a distal end extending toward said base member, said distal end of said trigger arm engaging said distal end of said lever arm when water is substantially removed from the tank thereby preventing pivoting of said lever arm by said buoyant float member when water is placed within the tank, said trigger assembly further having a counterweight attached to said trigger arm intermediate said first end of said trigger arm and said trigger pivot to bias said trigger arm in a position to engage said distal end of said trigger arm and said distal end of said lever arm; and a push button assembly mounted within a wall of the tank, said push button assembly having a push rod with a first end exterior the tank carrying a push button, and a second end having an enlarged diameter portion in contact with said disk member whereby movement of said push rod toward said disk member produces pivotal movement of said trigger arm and disengages said distal end of said trigger arm from said distal end of said lever arm whereby said buoyant float member moves said lever arm to said upper position and said flapper assembly to an open position by engaging said side extension of said plate of said flapper assembly.

12. The mechanism of claim 11 wherein said storage volume is provided with a slide member for covering a selected portion of said opening and adjusting said size of said opening in said bottom wall for selecting a time duration for said flapper assembly to remain in said open position.

13. The mechanism of claim 11 wherein said disk member on said trigger arm is provided with an adjustment whereby a distance between said disk member and said first end of said trigger arm can be selected.

14. The mechanism of claim 11 wherein said pivot assembly on said flapper assembly support portion of said base member is provided with a stop to engage said side extension of said flat plate of said flapper assembly to prevent excessive elevation of said flapper assembly by said lever arm.

15. The mechanism of claim 11 wherein said trigger assembly is mounted on said trigger assembly support portion of said base member with an orientation whereby a plane of motion of said trigger arm is orthogonal to a plane of motion of said lever arm, and wherein said push button assembly is mounted through a hole in a front surface of the storage tank.

16. The mechanism of claim 11 wherein said trigger assembly is mounted on said trigger assembly support portion of said base member with an orientation whereby a plane of motion of said trigger arm is parallel to a plane of motion of said lever arm, and wherein said push button assembly is mounted through a hole in a side surface of the storage tank.

* * * * *